United States Patent [19]

McGinley

[11] 4,351,367

[45] Sep. 28, 1982

[54] BEAT-UP SYSTEM

[75] Inventor: Thomas F. McGinley, Phillipsburg, N.J.

[73] Assignee: McGinley Mills, Inc., Phillipsburg, N.J. ; a part interest

[21] Appl. No.: 149,479

[22] Filed: May 13, 1980

[51] Int. Cl.[3] ..... D03D 41/00

[52] U.S. Cl. ..... 139/11; 139/191

[58] Field of Search ..... 139/11, 11 A, 188, 191, 139/192

[56] References Cited

U.S. PATENT DOCUMENTS

| | | | |
|---|---|---|---|
| 759,317 | 5/1904 | Saurer | 139/191 |
| 1,067,619 | 7/1913 | Moriggl | 139/191 |
| 3,590,880 | 7/1971 | Kathriner | 139/192 |
| 3,799,209 | 3/1974 | Dow et al. | 139/192 |
| 4,122,871 | 10/1978 | McGinley | 139/11 A |

*Primary Examiner*—Henry Jaudon

*Attorney, Agent, or Firm*—Weinstein & Sutton

[57] ABSTRACT

The present invention provides a method and apparatus for an improved beat-up system for beating up the weft threads into the fell of the fabric. The improved beat-up mechanism includes a plurality of spacer elements which are moved into and out of position between the warp threads for maintaining the spacing between the warp threads. The beat-up mechanism further includes a plurality of beat-up elements which are inserted into and out of position between the warp threads for beating up the weft threads onto the fell of the fabric. The beat-up elements also operate to maintain the spacing between the warp threads when the spacer elements are withdrawn from between the warp threads. In addition, the present invention discloses apparatus for increasing the spacing between adjacent groups of warp threads in the same plane so that weft-advancing arms or shed-retaining elements may be more easily inserted into the plane of the warp threads.

28 Claims, 19 Drawing Figures

BEAT-UP SYSTEM

FIELD OF THE INVENTION

The present invention relates generally to a method and apparatus for weaving in moving warp-shed systems and, more particularly, to an improved method and apparatus for continuously maintaining the spacing between warp threads while beating up the weft threads into the fell of the fabric.

BACKGROUND OF THE INVENTION

Weaving looms employing moving warp-shed systems are known in the art, such as disclosed in U.S. Pat. No. 4,122,871. After the weft thread is inserted into the moving sheds formed by the warp threads, the weft thread must be moved or beat up to form the fabric at one end of the loom. Such mechanisms for beating up the weft thread are also known in the prior art. For example, a number of different beat-up arrangements are disclosed in U.S. Pat. No. 4,122,871. In one embodiment, the beat-up mechanism forms a part of the shed-retaining mechanism and is carried by a conveyor toward the fell of the fabric. The beat-up mechanism advances the weft thread toward the fell of the fabric and operates to beat up the weft thread into the fell of the fabric and is then withdrawn from the warp threads to be returned along the lower run of the conveyor to repeat another cycle. In such an arrangement, the number of beat-up elements extending transversely across the loom is very large, as these elements must be closely spaced in order to retain the sheds and beat up the weft thread. However, because of the large number of beat-up elements, as they are moved in the direction of the warp threads toward the fell of the fabric, friction is produced between the beat-up elements and the warp threads.

In another embodiment of U.S. Pat. No. 4,122,871, the conveyor carries a plurality of weft-advancing arms which advance the inserted weft thread toward the end of the conveyor adjacent the fell of the fabric. At that point, the weft-advancing arms push the weft thread into rotating reed members, and the weft-advancing arms are withdrawn from their position between the warp threads and are returned along the lower run of the conveyor to repeat another cycle. As the reed members rotate, they beat up the weft thread into the fell of the fabric. Although this arrangement is generally satisfactory, the rotating reed members continuously rotate against the warp threads at the fell of the fabric and thereby cause undesired friction on the warp threads.

In addition, when the above-described beat-up members or weft-advancing arms are withdrawn from between the warp threads and are returned along the lower run of the conveyor to the upper run of the conveyor, the weft-advancing arms or beat-up members must be reinserted in the spacing between the warp threads. However, the warp threads are relatively closely spaced, and no apparatus is provided to ensure that the weft-advancing arms or beat-up members are always properly reinserted into the warp threads to maintain the desired spacing between the warp threads.

Accordingly, it is an object of the present invention to provide an improved method and apparatus which overcomes the aforesaid problems. Specifically, it is within the contemplation of the present invention to provide an improved beat-up system which substantially reduces the friction on the warp threads and operates to continuously maintain the desired spacing between the warp threads while the weft threads are beat up into the fell of the fabric.

It is also an object of the present invention to provide a two-part mechanism for beating up the weft threads while continuously maintaining the spacing of the warp threads, so that at least one part of the two-part beat-up mechanism is always inserted in position between the warp threads to maintain their proper spacing.

It is a further object of the present invention to provide an arrangement for increasing the spacing between certain adjacent warp threads in the same plane so that the elements for retaining sheds, for beat up, or for weft advance may be more easily inserted between the specific warp threads desired, as such elements are returned to the upper run of the loom conveyor.

SUMMARY OF THE INVENTION

Briefly, in accordance with the principles of the present invention, an improved method and apparatus is provided for beating up weft threads. More particularly, a plurality of spacer elements is disposed between the end of the conveyor and the fell of the fabric and is movable into and out of position between the warp threads for maintaining the proper spacing between the warp threads. In addition, a plurality of beat-up elements cooperates with the spacer elements and is also movable into and out of position between the warp threads and operate to beat up the weft threads into the fell of the fabric and also operate to maintain the spacing of the warp threads when the spacer elements are withdrawn from the warp threads.

Advantageously, as a result of the present invention, before the spacer elements are withdrawn from between the warp threads, the beat-up elements are inserted between the warp threads to maintain their proper spacing. Then the spacer elements are withdrawn, and the beat-up elements operate to beat up the weft threads into the fell of the fabric. After the beat-up operation is completed, the spacer elements are reinserted between the warp threads at the positions maintained by the beat-up elements which are then withdrawn so that the subsequent weft thread can be moved forwardly toward the fell of the fabric. In this manner, the spacer elements and beat-up elements cooperate to continuously maintain the spacing of the warp threads. In addition, as there is no reed member continuously rotating against the fell of the fabric, as in the prior art, the amount of friction caused with respect to the warp threads is substantially reduced. Still further, since weft-advancing arms are employed to advance the weft threads to their beat-up position adjacent the fell of the fabric, instead of the large number of beat-up elements which traverse the warp threads with the shed retainers, this also results in substantially reduced friction on the warp threads.

As a still further advantage, the present invention utilizes a positive beat-up action. That is, the weft thread is always beat up to the desired position regardless of the amount of, or changes in, the opposing tensions at the fell of the fabric. The beat-up elements actually remain stationary at the fell of the fabric for a considerable portion of the picking cycle. This extended duration of beat-up pulse achieves higher weft densities in the fabric with a less severe tension peak on the warp threads when compared to the instantaneous beating-up action of the conventional slay.

In accordance with the present invention, there is also provided apparatus for increasing the spacing between certain adjacent warp threads in the same plane, which apparatus is located adjacent to the shed-forming elements, so that the shed-retaining elements and the weft-advancing arms may be more easily inserted between the warp threads. More particularly, a plurality of pairs of metal wires is suspended substantially perpendicular relative to the longitudinally-extending warp threads, and the lower sections of such pairs of wires are bent away from each other to form an increased spacing between the wires. As a result, as the warp threads are separated into upper and lower planes, the lower plane of warp threads is moved relative to the lower sections of such wires with the increased spacing. As a result, the spacing between adjacent groups of warp threads in the lower plane of warp threads is increased so that shed-retaining elements and weft-advancing arms may be more easily inserted between the warp threads in the lower plane of warp threads, and so that the shed-retaining elements and weft-advancing arms are inserted between the desired warp threads.

BRIEF DESCRIPTION OF THE DRAWINGS

Further objects, features, and advantages of the present invention will become apparent upon the consideration of the following detailed description of presently preferred embodiments when taken in conjunction with the accompanying drawing, wherein.

DETAILED DESCRIPTION OF PREFERRED EMBODIMENTS OF THE INVENTION

Figure 1:
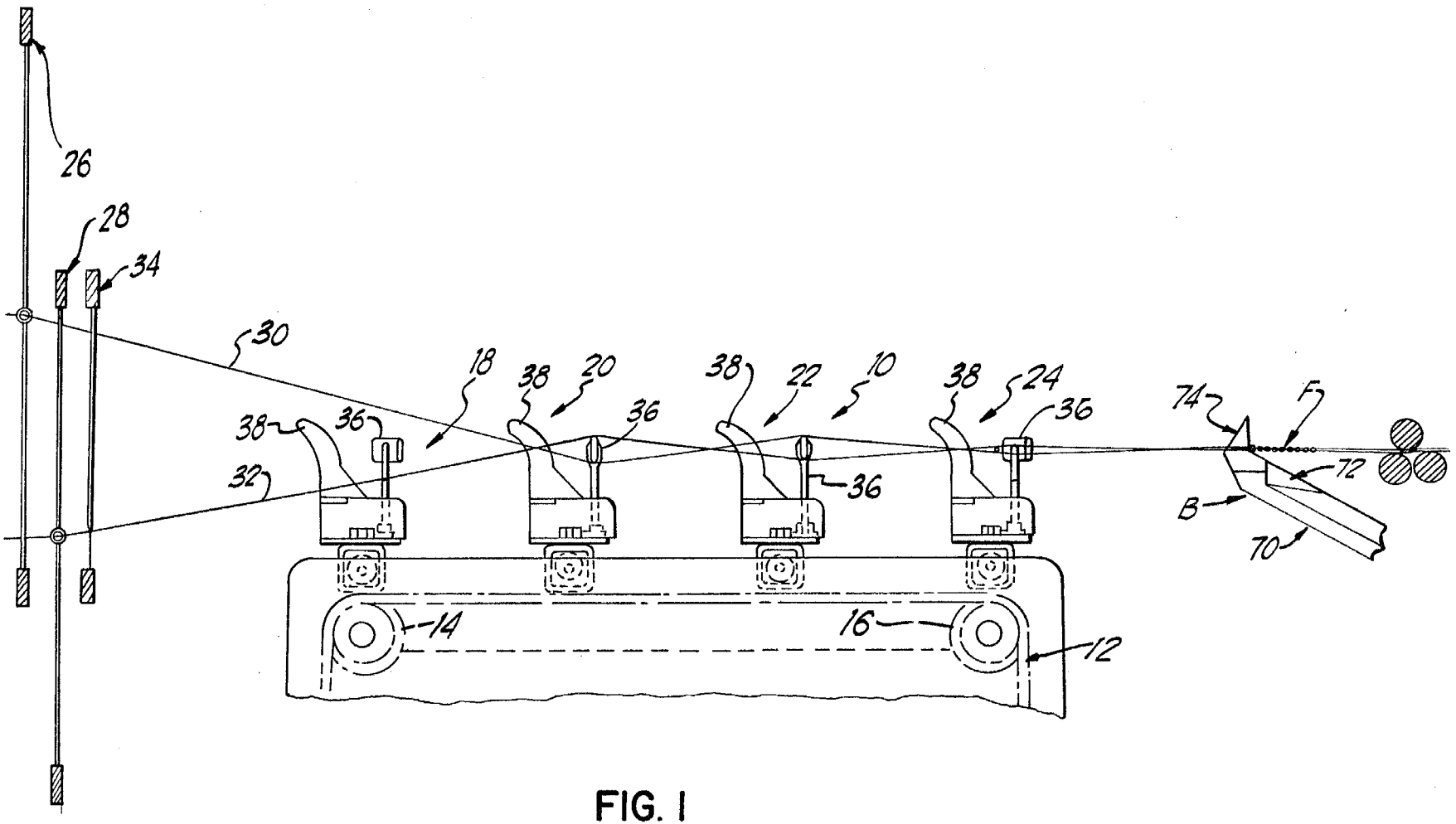
FIG. 1 is a side elevational view of the apparatus for forming, retaining, and moving warp sheds to a beat-up position and beat-up apparatus embodying the principles of the present invention for beating up the weft threads into the fell of the fabric.

Referring to FIG. 1, there is shown a weaving loom 10 embodying the principles of the present invention. More particularly, a conveyor 12 mounted on sprockets 14, 16 is employed to convey stations 18, 20, 22, and 24 toward the fell of the fabric F, in a manner more fully explained in U.S. Pat. No. 4,122,871. Shed-forming mechanisms 26, 28 are also employed to separate the warp threads 30, 32 into sheds so that the weft thread can be inserted while the sheds are moved toward the fell of the fabric. As these mechanisms are of conventional construction, they need not be described in detail. In fact, any shed-forming apparatus may be employed. As is well known in the art, when shed-forming mechanisms 26, 28 are moved relative to each other, they operate to separate adjacent warp threads 30, 32 into upper and lower planes to form the warp sheds for the insertion of weft thread. In addition, a frame member 34 is provided which operates to increase the spacing between lower warp threads 32 so that the shed retainers may be inserted between the warp threads, in a manner to be explained. Also, there is shown a portion of the improved beat-up system 70 of the present invention, including spacer elements 72 and beat-up elements 74.

Still referring to FIG. 1, it will be noted that each of the stations 18, 20, 22, and 24 include a shed retainer 36 which is movable between a shed-releasing position and a shed-retaining position, as more fully explained in U.S. Pat. No. 4,122,871 and copending application Ser. No. 58,790, filed July 19, 1979. As shown in FIG. 1, shed retainer 36 of stations 18, 24 are in their shed-releasing position, whereas shed retainers 36 of stations 20, 22 are in their shed-retaining positions. In addition, each of these stations include members or arms 38 for advancing the weft thread toward the fell of the fabric after it has been inserted into each of the warp sheds.

Figure 3:
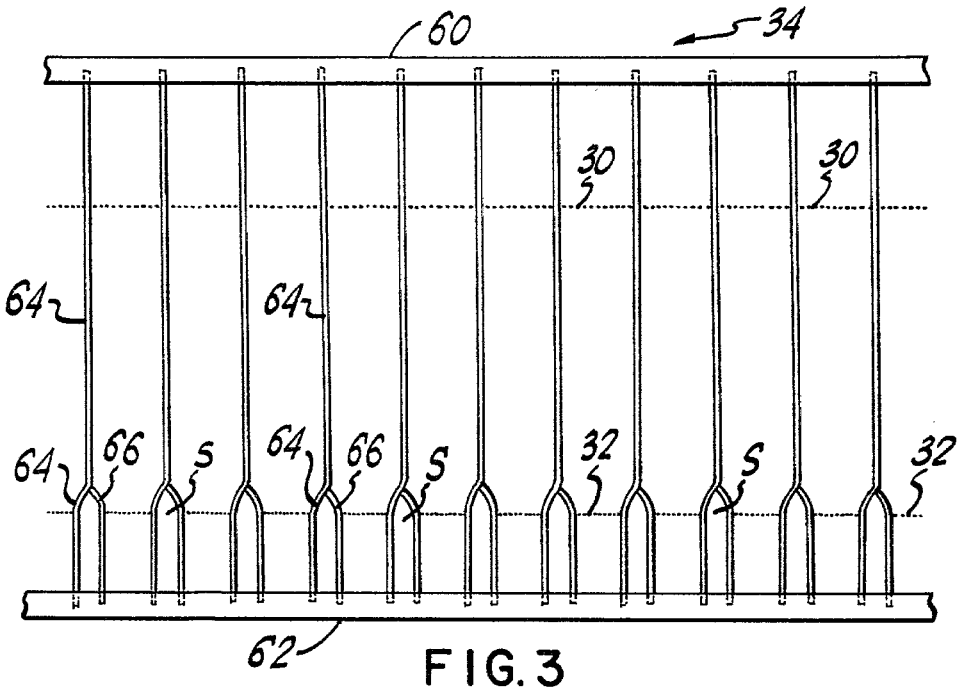
FIG. 3 is a front elevational view of the apparatus for increasing the spacing of the warp threads.
Figure 4:
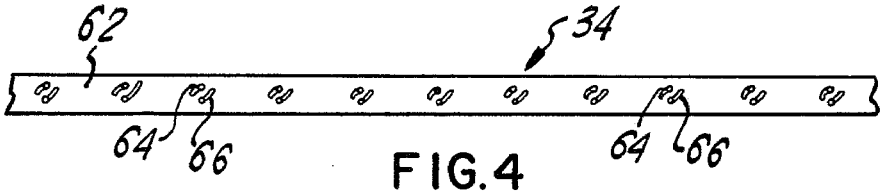
FIG. 4 is a top plan view of the spacing apparatus shown in FIG. 3.

Referring now to FIGS. 3 and 4, spacing frame 34 is more clearly illustrated. Spacing frame 34 includes upper and lower cross members 60, 62 between which a plurality of pairs of wires 64, 66 are disposed. As will be noted, the lower sections of wires 64, 66 are bent or deformed to form a somewhat U-shaped configuration to increase the spacing between adjacent groups of lower warp threads 32. In this manner, the bent portions of wires 64, 66 operate to increase the spacings S between adjacent groups G of warp threads 32 so that shed-retaining elements 36 and weft-advancing members 38 may be inserted into such spaces. Retaining elements 36 are inserted into spaces S while in their shed-releasing positions and are then rotated to their shed-retaining positions once they are inside the warp sheds. Without wires 64, 66 increasing the spacing between adjacent groups of warp threads 32, there would be no assurance that the shed-retaining elements 36 or arms 38 would be inserted between the desired groups G of warp threads.

Figure 2:
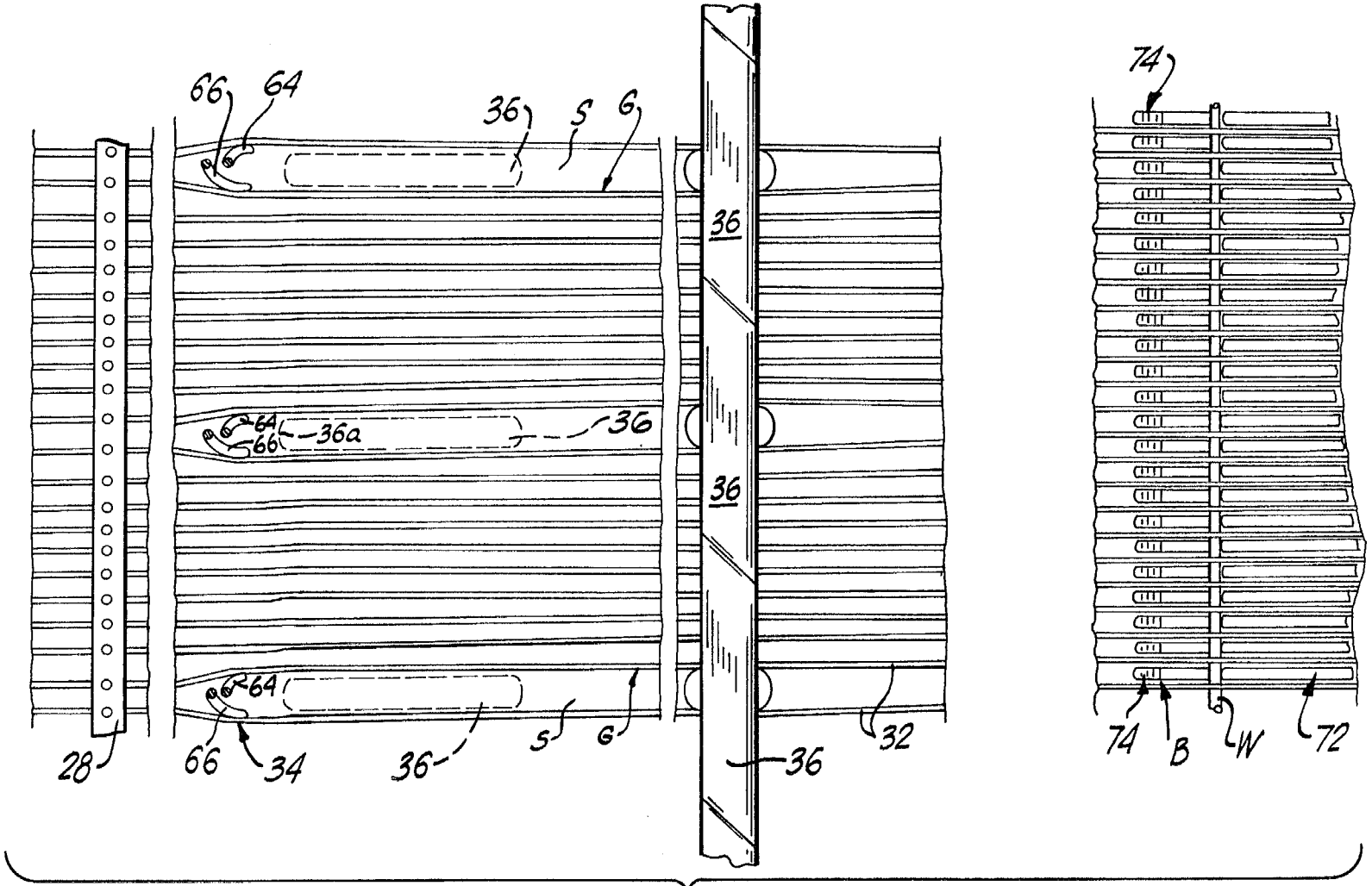
FIG. 2 is a top plan view of the apparatus shown in FIG. 1 illustrating the spacing of the longitudinally-extending warp threads between the shed-forming apparatus and the beat-up apparatus.

Referring to FIG. 2, shed retainers 36 are shown in dotted lines as they begin to enter the spaces S between the groups G of warp threads. As will be noted, the shed retainers 36 enter the spaces S with their leading edges 36*a* approximately in the center of the spaces S. This is to insure that the shed retainers 36 enter between the desired groups G of warp threads. After the shed retainers have entered between the warp threads 32, the shed retainers are rotated to their shed-retaining positions, shown in solid line in FIG. 2.

Once the shed-retaining elements 36 have been pivoted to their shed-retaining positions, as shown in FIGS. 1 and 2, they operate to retain the warp sheds as they traverse the upper run of conveyor 12 toward the fell of the fabric. During this time, weft thread is inserted in each of the warp sheds as they traverse the upper run of the conveyor, in a manner more fully explained in U.S. Pat. Nos. 4,122,871 and 4,122,872. Although not shown in the drawings, it should be understood that the weft thread may be inserted by fluid jets, or shuttles, or gripper shuttles. Further, guides may also be provided for such fluid jets or shuttles. In addition, after shed-retaining elements 36 are pivoted to their shed-releasing positions near the end of the upper run of conveyor 12, weft-advancing elements 38 operate to engage and push the weft threads towards the fell of the fabric.

Figure 6:
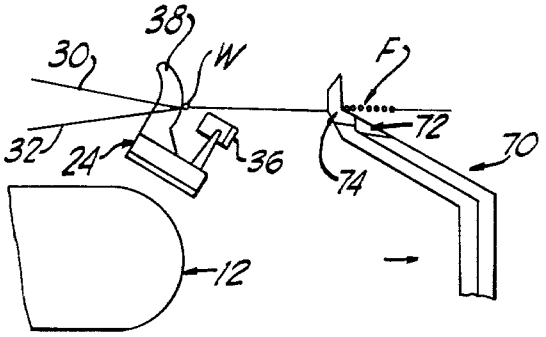
FIGS. 6 to 11 illustrate in sequence the operation of the improved beat-up apparatus of the present invention.
Figure 7:
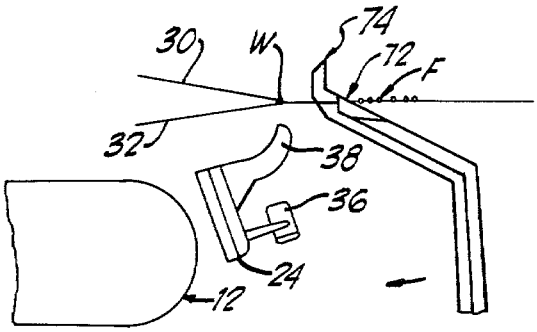

Referring now to FIGS. 2 and 6, the improved beat-up mechanism 70 of the present invention is more clearly illustrated. As shown most clearly in FIG. 2, the beat-up mechanism consists of a plurality of spacer elements 72 and a plurality of beat-up elements 74, which extend transversely across the loom and are adapted to be inserted between all of the longitudinally-extending warp threads 30, 32. These elements 72, 74 cooperate with each other to maintain the proper spacing between adjacent warp threads 30, 32 while beating up the weft threads W into the fell of the fabric. As shown in FIGS. 6 to 11, spacer elements 72 are inserted between the warp threads to maintain the spacing of the warp threads. Also, beat-up elements 74 are inserted between the warp threads to maintain the spacing of the warp threads when spacer elements 72 are withdrawn from between the warp threads. In addition, beat-up elements 74 also operate to beat up the weft thread W into the fell of the fabric F while maintaining the spacing between the warp threads. The driving arrangement for spacer elements 72 and beat-up elements 74 will be more clearly explained in conjunction with FIGS. 18 and 19. However, in order to understand the operation of beat-up system 70, reference is made to the sequence of operation in FIGS. 6 to 11.

Figure 8:
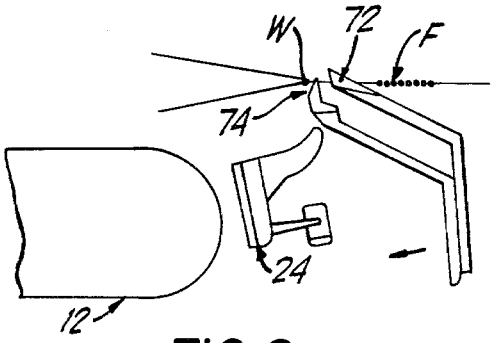
Figure 9:
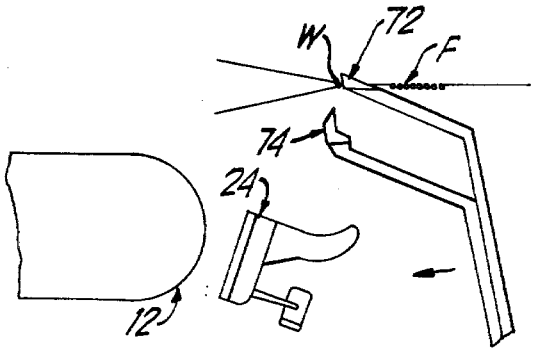
Figure 10:
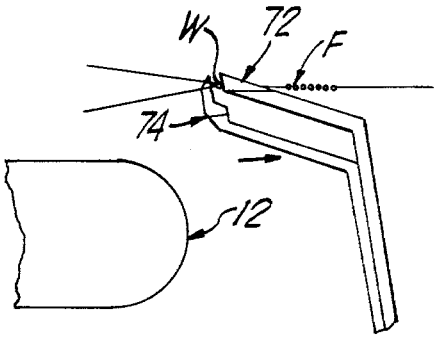
Figure 11:
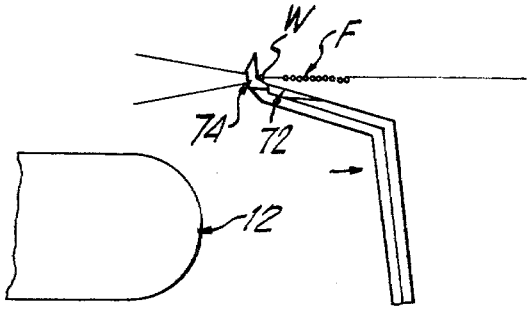

As shown in FIG. 6, conveyor 12 operates to bring one of the stations, for example, station 24 toward the beat-up mechanism 70. Weft-advancing member 38 operates to advance the weft thread W toward the beat-up mechanism 70. As will be noted from FIGS. 6 and 7, as station 24 continues its traverse of conveyor 12, advancing member 38 is withdrawn from between the warp threads and no longer operates to move the weft thread W forwardly towards the fell of the fabric. The weft thread W remains at this position, referred to as the beat-up position, until it is engaged by the beat-up mechanism 70. Then, beat-up elements 74 are moved upward and away from the fell of the fabric, toward weft thread W, as the spacer elements 72, moving together with elements 74, are inserted into position between the warp threads. As shown in FIG. 8, beat-up elements 74 are then withdrawn from between the warp threads so that weft thread W can be moved forwardly toward the fell of the fabric. As will be noted from FIGS. 8 and 9, while beat-up elements 74 are in their withdrawn position from the warp threads, spacer elements 72 operate to maintain the desired spacing between adjacent warp threads. As will be understood from FIGS. 8, 9, and 10, beat-up elements 74 are retracted, in a direction away from the fell of the fabric, so that they are brought behind the weft thread W, as shown most clearly in FIG. 9. Once beat-up elements 74 have been brought to a point behind weft thread W, the beat-up elements 74 are reinserted between the warp threads and behind the weft thread W, as shown in FIG. 10. As spacer elements 72 are already in position between the warp threads, they operate to maintain the spacing between the warp threads so that the beat-up elements 74 can be properly reinserted. As will also be understood from FIG. 9, as spacer elements 72 continue to move in a rearward direction, they operate to push the weft thread W back slightly toward the beat-up elements 74 so as to insure that the weft thread W is in contact with elements 72 along their entire length. Then, as shown in FIGS. 10 and 11, elements 74 are raised into the warp threads behind the weft thread. As elements 74 begin beat up, then spacer elements 72 are concurrently withdrawn from the warp threads to seat on elements 74. Then the beat-up elements 74, moving with the spacer elements 72, operate to push the weft thread W into the fell of the fabric. The beat-up mechanism 70 is then ready to repeat the cycle of operation to receive the next weft thread and to beat it up into the fell of the fabric.

Another embodiment for an improved beat-up system in accordance with the present invention is shown in FIGS. 12 to 17, which also illustrate the sequence of operation, in a manner similar to FIGS. 6 to 11. In this embodiment, the beat-up mechanism is shown at 80 and is disposed above the plane of the warp threads. Therefore, in accordance with the present invention, the beat-up and spacer elements for beating up the weft thread may be disposed below the plane of the warp threads, as shown in FIGS. 6 to 11, or may be disposed above the plane of the warp threads, as shown in FIGS. 12 to 17.

Figure 12:
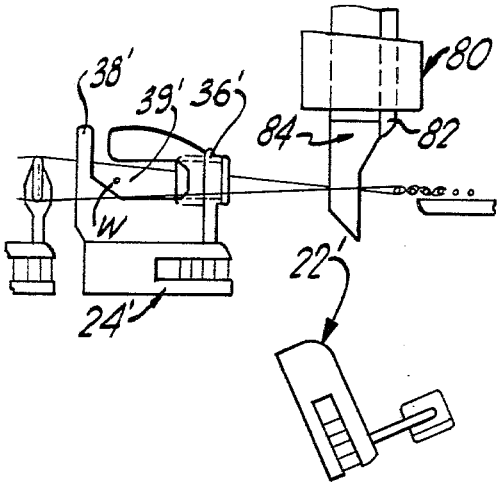
FIGS. 12 to 17 illustrate in sequence the operation of another form of beat-up apparatus in accordance with the present invention.
Figure 13:
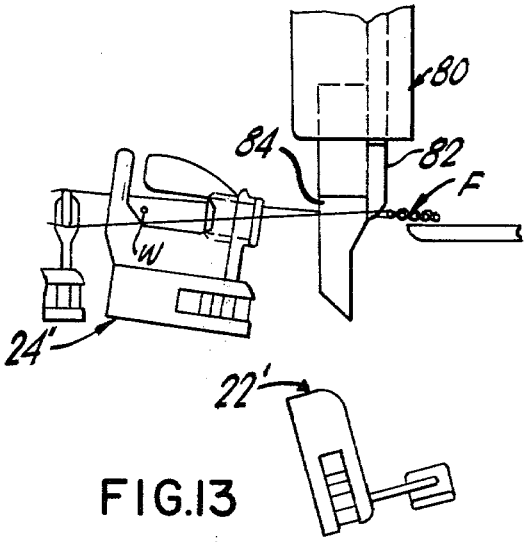
Figure 14:
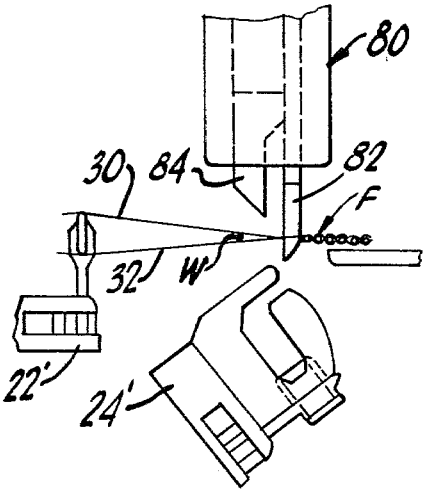
Figure 15:
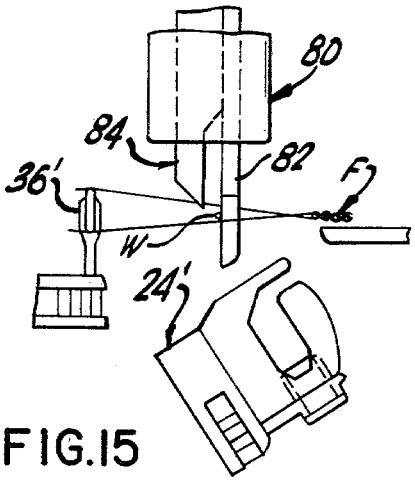
Figure 16:
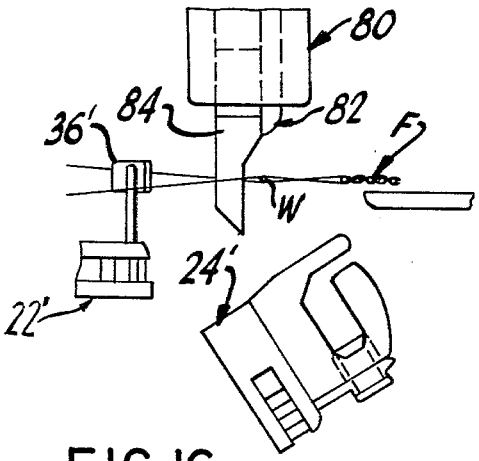
Figure 17:
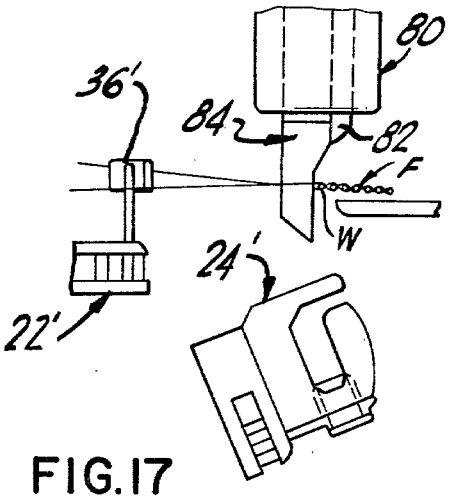

As shown in FIG. 12, stations 24' and 22' are carried by the loom conveyor and operate to retain and move the warp sheds toward the fell of the fabric, as described in U.S. Pat. No. 4,122,871. As will be noted, station 24' includes a shed-retaining element 36' and a weft-advancing arm 38'. In addition, station 24' includes a guide 39' for a gripper shuttle for inserting the weft thread in the warp sheds. As shown in the sequence of FIGS. 12 to 14, weft-advancing arm 38' moves the weft thread W to a beat-up position shown in FIG. 14. During this portion of the cycle, as the station 24' continues its traversal with the conveyor, weft-advancing arm 38' is withdrawn from between the warp threads leaving the weft thread at the beat-up position. At this point, the structure and operation of beat-up mechanism 80 can be explained. As will be noted, beat-up mechanism 80 includes a plurality of spacer elements 82 and a plurality of beat-up elements 84 extending transversely across the loom. Referring to FIGS. 12 and 13, it will be noted that while beat-up element 84 is in position between the warp threads, spacer element 82 is inserted. Then, as shown in FIG. 14, with spacer elements 82 maintaining the spacing, beat-up elements 84 are withdrawn from between the warp threads. This allows beat-up mechanism 80 to move away from the fell of the fabric (see FIGS. 14 and 15) and bring beat-up elements 84 to a position behind the weft thread W to be beat up. In addition, as shown in FIGS. 15 and 16, beat-up elements 84 are then inserted into position between the warp threads before spacer elements 82 are retracted from between the warp threads. In this manner, at least one of the elements 82 or 84 is always in position between the warp threads to continuously maintain the proper spacing of the warp threads. Then, as shown in FIG. 16, once the beat-up elements 84 are completely inserted within the warp threads, beat-up mechanism 80 and beat-up elements 84 are moved forwardly toward the fell of the fabric F to beat up the weft thread W into the fell of the fabric, as shown in FIG. 17. When weft thread W has been beat up and beat-up mechanism 80 is in its dwell position, this completes a cycle of operation of beat-up mechanism 80. Then, as shown in FIG. 12, to begin a new cycle, beat-up mechanism 80 is retracted away from the fell of the fabric and is ready to repeat the cycle of operation and receive the next weft thread W to beat it up into the fell of the fabric.

Figure 5:
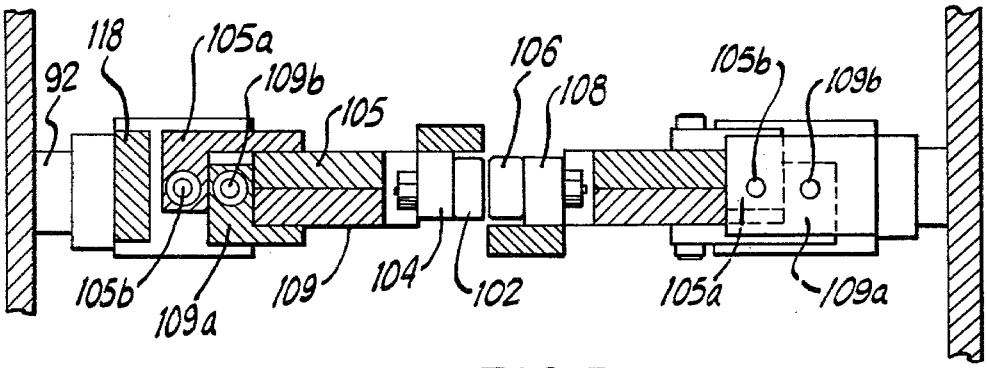
FIG. 5 is a partial sectional view of the improved beat-up apparatus shown in FIG. 18 taken along lines 5—5 of FIG. 18.
Figure 18:
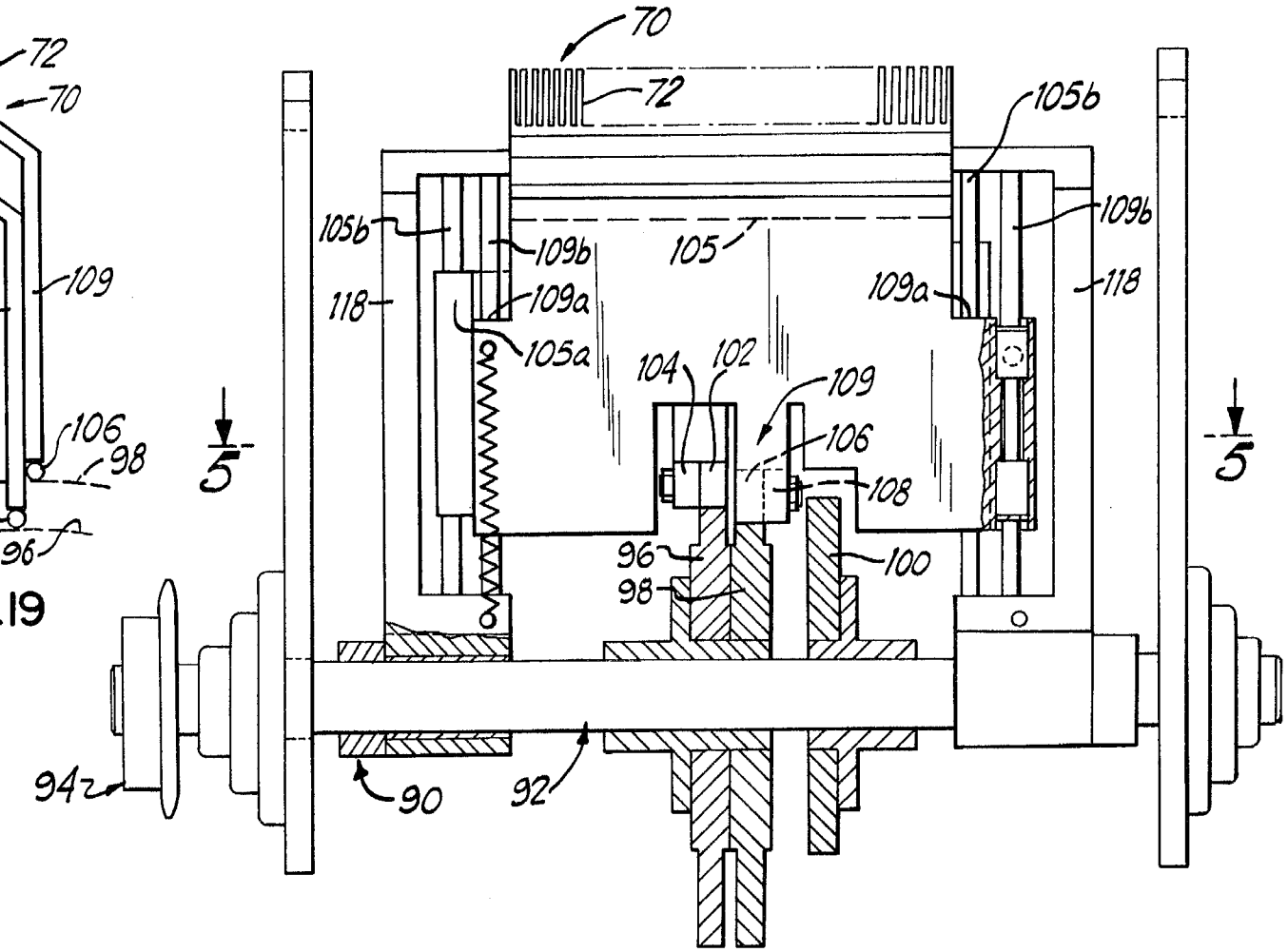
FIG. 18 is an elevational view, partly in section, illustrating the driving apparatus of the beat-up apparatus of the present invention.
Figure 19:
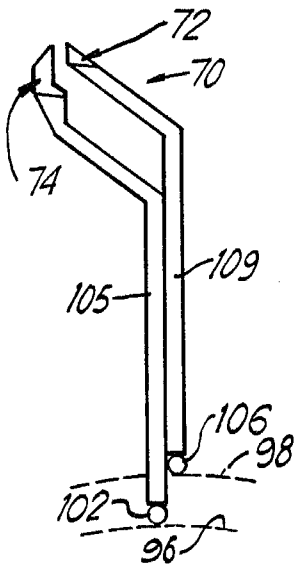
FIG. 19 is a sectional view of FIG. 18 illustrating in detail the spacer and beat-up elements of the beat-up apparatus of the present invention.

Referring now to FIGS. 5, 18, and 19, a suitable driving arrangement for operating the beat-up mechanism 70 is illustrated. As shown in FIG. 18, the driving arrangement 90 includes a shaft 92 driven in any suitable manner, such as by a belt and pulley arrangement 94, shown at one end of the shaft 92. Three cams 96, 98, and 100 are mounted on shaft 92 for operating the beat-up mechanism 70. More particularly, cam 96 drives a cam follower 102 which is bolted to an L-shaped member 104 connected to a rear support member 105. Support member 105 supports the assembly of beat-up elements 74. (See FIG. 19.) Similarly, cam 98 operates to drive a cam follower 106 which is bolted to an L-shaped member 108 connected to a front support member 109. Support member 109 supports the assembly of spacer elements 72. (See FIG. 19.) In addition, support members 109, 105 slide up and down with their front and rear guide portions 109*a*, 105*a*, respectively. As will be noted, these guides are slideable on guiding members 109*b*, 105*b*, respectively, and are supported on frame member 118. In this manner, cams 96 and 98 control the up-and-down movement of beat-up mechanism 70, including moving elements 74 and 72 into and out of position between the warp threads. In addition, as cam 100 rotates, it controls the back-and-fourth movement of beat-up mechanism 70 toward and away from the fell of the fabric by a suitable linkage arrangement (not shown). Of course, it should be understood that a similar driving arrangement may be employed to drive beat-up mechanism 80. In addition, other driving arrangements may be employed to drive beat-up mechanisms 70 or 80, and the foregoing arrangement is merely for purposes of illustration.

In view of the foregoing, it will be appreciated that there has been provided in accordance with the present invention an improved beat-up system which substantially reduces the friction of the beat-up apparatus on the warp threads, and also operates to continuously maintain the spacing between the warp threads while beating up the weft threads into the fell of the fabric. In addition, spacing frame 34, which operates to increase the spacing between the warp threads, also insures that the shed retainers and weft-advancing arms are properly reinserted into the plane of the warp threads at their proper locations.

The present invention also has application to weft-wave type systems. However, a screw-type cam or the like would have to be employed to operate the spacer elements and beat-up elements in sequence in a transverse direction across the loom. Accordingly, it should be understood that the improved beat-up system and spacing frame of the present invention may be employed in all types of multished weaving looms, such as, for example, the Kontis multiphase loom.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for weaving employing warp threads and weft threads, comprising:

means for separating the warp threads into different planes to form warp sheds;

means for retaining said warp sheds;

means for moving said warp sheds and said shed-retaining means in the direction of said warp threads toward the fell of the fabric;

means for inserting weft thread through said moving warp sheds;

means for advancing said inserted weft threads to a beat-up position adjacent the fell of the fabric;

spacer means movable into and out of position between said warp threads for maintaining the spacing between said warp threads;

beat-up means cooperating with and movable relative to said spacer means, said beat-up means being movable into and out of position between said warp threads for beating up said weft threads from said beat-up position into the fell of the fabric and maintaining the spacing of said warp threads when said spacer means are withdrawn from said warp threads; and said spacer means and said beat-up means being disposed on only one side of said warp threads.

2. Apparatus in accordance with claim 1, wherein said spacer means includes a plurality of spacer elements insertable between said warp threads, and wherein said beat-up means includes a plurality of beat-up elements insertable between said warp threads.

3. Apparatus in accordance with claim 2 wherein said spacer means and said beat-up means include means for driving said spacer elements and said beat-up elements into and out of position between said warp threads from below said warp threads.

4. Apparatus in accordance with claim 2 further including first cam means for driving said spacer elements and second cam means for driving said beat-up elements so that said spacer elements and said beat-up elements are moved relative to each other.

5. Apparatus in accordance with claim 2 wherein said spacer means and said beat-up means include means for driving said spacer elements and said beat-up elements into and out of position between said warp threads from above said warp threads.

6. Apparatus in accordance with claim 1 further including means for increasing the spacing between adjacent warp threads in the same plane so that said retaining means may be inserted between said warp threads.

7. Apparatus in accordance with claim 6 wherein said space-increasing means includes elements disposed between said warp threads, the lower sections of said elements forming U-shaped configurations to increase the spacing between adjacent warp threads.

8. Apparatus for weaving employing warp threads and weft threads, comprising:

means for separating said warp threads into different planes to form warp sheds;

means for retaining and moving said warp sheds in the direction of said warp threads toward the fell of the fabric;

means for inserting weft thread through said moving warp sheds;

means for advancing said inserted weft threads to a beat-up position adjacent the fell of the fabric; and spacer means and beat-up means movable relative to each other and movable into and out of position between said warp threads adjacent the fell of the fabric for continuously maintaining the spacing between said warp threads and for beating up said weft threads from said beat-up position into the fell of the fabric while maintaining the spacing between said warp threads.

9. Apparatus in accordance with claim 8 wherein said spacer means includes a plurality of spacer elements insertable between said warp threads for maintaining the spacing between said warp threads and said beat-up means includes a plurality of beat-up elements insertable between said warp threads for beating up said weft threads while maintaining the spacing between said warp threads.

10. Apparatus in accordance with claim 8 further including means for increasing the spacing between adjacent warp threads in the same plane so that said retaining means may be inserted between said warp threads.

11. Apparatus in accordance with claim 10 wherein said space-increasing means includes elements disposed between said warp threads, the lower sections of said elements forming U-shaped configurations to increase the spacing between adjacent warp threads.

12. A method of weaving employing warp threads and weft threads, comprising the steps of:

separating the warp threads into different planes to form warp sheds;

retaining and moving said warp sheds in the direction of said warp threads toward the fell of the fabric;

inserting weft threads through said moving warp sheds;

advancing said inserted weft threads to a beat-up position adjacent the fell of the fabric; and inserting spacer means and beat-up means which are movable relative to each other between said warp threads from one side of said warp threads adjacent the fell of the fabric for continuously maintaining the spacing between said warp threads and for beating up said weft threads from said beat-up position into the fell of the fabric.

13. A method in accordance with claim 12 wherein the step of beating up said weft threads includes moving said beat-up means forward toward the fell of the fabric, stopping the forward movement of said beat-up means at the fell of the fabric, and holding said beat-up means in said beat-up position at the fell of the fabric for a portion of the weaving cycle.

14. A method in accordance with claim 12 further including the step of increasing the spacing between adjacent warp threads in the same plane so that retaining elements may be inserted between said warp threads.

15. A method in accordance with claim 12 wherein the step of inserting includes the step of inserting said spacer means and said beat-up means from below said warp threads.

16. A method in accordance with claim 12 wherein the step of inserting includes the step of inserting said spacer means and said beat-up means from above said warp threads.

17. A method of weaving employing warp threads and weft threads, comprising the steps of:

separating the warp threads into different planes to form warp threads;

retaining and moving said warp sheds in the direction of said warp threads toward the fell of the fabric;

inserting weft threads through said moving warp sheds;

advancing said inserted weft threads to a beat-up position adjacent the fell of the fabric;

moving a plurality of spacer elements into and out of position between said warp threads for maintaining the spacing between said warp threads; and inserting a plurality of beat-up elements into and out of position between said warp threads for beating up said weft threads from said beat-up position into the fell of the fabric, said beat-up elements maintaining the spacing between said warp threads when said spacer elements are withdrawn from said threads, and said beat-up elements and said spacer elements being movable relative to each other.

18. A method in accordance with claim 17 further including the step of increasing the spacing between adjacent warp threads in the same plane so that retaining elements may be inserted between said warp threads.

19. A method in accordance with claim 17 wherein the step of inserting beat-up elements includes the step of inserting said beat-up elements from below said warp threads.

20. A method in accordance with claim 17 wherein the step of inserting beat-up elements includes the step of inserting said beat-up elements from above said warp threads.

21. A method in accordance with claim 17 wherein the step of beating up said weft threads includes moving said beat-up elements forward toward the fell of the fabric, stopping the forward movement of said beat-up elements at the fell of the fabric, and holding said beat-up elements in said beat-up position at the fell of the fabric for a portion of the weaving cycle.

22. A method of weaving employing warp threads and weft threads, and wherein sheds are formed from said warp threads and moved while weft threads are inserted into said warp sheds, and wherein said inserted weft threads are moved toward the fell of the fabric, the improvement comprising the steps of:

moving a plurality of spacer elements into and out of position between said warp threads adjacent the fell of the fabric for maintaining the spacing between said warp threads; and inserting a plurality of beat-up elements which are movable relative to said spacer elements into and out of position between said warp threads adjacent the fell of the fabric for beating up said weft threads into the fell of the fabric, said beat-up elements maintaining the spacing between said warp threads when said spacer elements are withdrawn from said warp threads, said beat-up elements being inserted into said warp threads from the same side of said warp threads as said spacer elements.

23. A method in accordance with claim 22 further including the step of increasing the spacing between adjacent warp threads in the same plane so that retaining elements may be inserted between said warp threads.

24. A method in accordance with claim 22 wherein the step of inserting beat-up elements includes the step of inserting said beat-up elements from below said warp threads.

25. A method in accordance with claim 22 wherein the step of inserting beat-up elements includes the step of inserting said beat-up elements from above said warp threads.

26. Apparatus for weaving employing warp threads and weft threads, comprising:

separating means for separating the warp threads into different planes to form warp sheds;

means for retaining said warp sheds;

means for moving said warp sheds in the direction of said warp threads toward the fell of the fabric;

means for inserting weft threads through said moving warp sheds;

means for advancing and beating up said inserted weft threads into the fell of the fabric;

the improvement comprising means for increasing the spacing between adjacent groups of desired warp threads in the same plane so that said shed-retaining means may be inserted between said warp threads, said space increasing means disposed adjacent said separating means; and spacer and beat-up means movable relative to each other and movable into and out of position between said warp threads adjacent the fell of the fabric for continuously maintaining the spacing between said warp threads and for beating up said weft threads from said beat-up position into the fell of the fabric while maintaining the spacing between said warp threads.

27. Apparatus in accordance with claim 26 wherein said space-increasing means includes spaced-apart elements which form U-shaped configurations for increasing the spacing between adjacent groups of warp threads.

28. A method of weaving employing warp threads and weft threads, comprising:

separating the warp threads into different planes to form warp sheds at a shed-forming station;

employing shed-retaining means to retain and move said warp sheds in the direction of said warp threads toward the fell of the fabric;

inserting weft threads through said moving warp sheds;

advancing and beating up said inserted weft threads into the fell of the fabric;

the improvement comprising the step of increasing the spacing of at least some of said warp threads adjacent said shed-forming station so that said shed-retaining means are inserted between desired groups of warp threads and continuously maintaining the spacing between said warp threads employing spacer and beat-up means movable relative to each other and movable into and out of position between said warp threads adjacent the fell of the fabric and for beating up said weft threads from said beat-up position into the fell of the fabric while maintaining the spacing between said warp threads.

* * * * *